US008608019B2

(12) United States Patent
Wren

(10) Patent No.: US 8,608,019 B2
(45) Date of Patent: Dec. 17, 2013

(54) DETACHABLE FOLDABLE HANDLE FOR DRINKING VESSELS

(76) Inventor: David T. Wren, Somers, NY (US)

( * ) Notice: Subject to any disclaimer, the term of this patent is extended or adjusted under 35 U.S.C. 154(b) by 628 days.

(21) Appl. No.: 12/463,274

(22) Filed: May 8, 2009

(65) Prior Publication Data

US 2010/0282767 A1 Nov. 11, 2010

(51) Int. Cl.
*B65D 25/28* (2006.01)

(52) U.S. Cl.
USPC ..... 220/757; 220/759

(58) Field of Classification Search
USPC ..... 220/757, 759, 769, 758, 752, 741, 742, 220/737; 16/425, 422, 429
See application file for complete search history.

(56) References Cited

U.S. PATENT DOCUMENTS

| | | | | |
|---|---|---|---|---|
| 751,009 | A | 2/1904 | Puterbaugh et al. | |
| 1,133,442 | A * | 3/1915 | Marcinkowski | 220/759 |
| 1,586,020 | A * | 5/1926 | Witherspoon | 220/764 |
| 1,688,165 | A * | 10/1928 | Tehel | 220/759 |
| 2,010,317 | A | 8/1935 | Olson | |
| 2,128,466 | A * | 8/1938 | Machotka | 294/33 |
| 2,215,402 | A | 9/1940 | McDonald | |
| 2,639,502 | A * | 5/1953 | Wormelle, Jr. | 30/450 |
| 2,648,900 | A * | 8/1953 | Anderson | 30/450 |
| 2,838,202 | A * | 6/1958 | Huether | 220/741 |
| 2,871,051 | A | 1/1959 | Nesslein et al. | |
| 3,014,621 | A * | 12/1961 | Povitz | 222/183 |
| 3,151,798 | A | 10/1964 | Meagher | |
| 3,357,623 | A | 12/1967 | Wommelsdorf | |
| D232,614 | S | 9/1974 | Brown | |
| 3,867,738 | A | 2/1975 | Garner | |
| 3,967,848 | A | 7/1976 | Sowle | |
| 3,979,011 | A * | 9/1976 | Schleicher | 220/742 |
| 4,120,073 | A | 10/1978 | Studebaker | |
| 4,127,915 | A * | 12/1978 | Logan et al. | 294/33 |
| D251,175 | S | 2/1979 | Logan et al. | |
| D254,417 | S | 3/1980 | DeMars et al. | |
| 4,230,235 | A | 10/1980 | Di Amico | |
| D265,279 | S | 7/1982 | Wright | |
| 4,379,578 | A | 4/1983 | Schuler | |
| 4,433,864 | A * | 2/1984 | Byrd | 294/27.1 |
| D291,405 | S | 8/1987 | Finesman et al. | |
| 4,685,583 | A | 8/1987 | Noon | |

(Continued)

FOREIGN PATENT DOCUMENTS

| | | |
|---|---|---|
| CA | 2168801 | 4/1996 |
| CA | 2322264 | 4/2001 |

(Continued)

*Primary Examiner* — Steven A. Reynolds
*Assistant Examiner* — King M Chu
(74) *Attorney, Agent, or Firm* — Eric B Alspaugh, APC

(57) ABSTRACT

A reusable, foldable, detachable handle is disclosed that can grip a drinking vessel by pressing against both the upper and lower rims of the vessel, thereby providing stable and reliable attachment thereto. The detachable handle can be folded when not in use for easy carrying and storage, and when in use it can be fixed in an unfolded configuration by a sleeve or flap that spans a foldable portion. Preferred embodiments allow attachment to vessels of different heights by being adjustable in length and/or by including a plurality of base-gripping features at different locations along the handle. Some preferred embodiments include gripping spike that enhances gripping security by applying opposing pressure to the upper rim. The gripping spike can be fixed in location or slidable along the handle. Further preferred embodiments include a bottle opener, and some preferred embodiments are attachable to a key ring or include a key ring.

6 Claims, 11 Drawing Sheets

(56) References Cited

U.S. PATENT DOCUMENTS

| | | | | |
|---|---|---|---|---|
| 4,765,581 | A | 8/1988 | Wallace et al. | |
| 4,896,913 | A | 1/1990 | Kennedy | |
| 4,993,675 | A | 2/1991 | Walker | |
| 5,002,193 | A | 3/1991 | Touzani | |
| 5,054,638 | A * | 10/1991 | Rose | 220/759 |
| 5,203,471 | A * | 4/1993 | Widman | 220/755 |
| 5,259,653 | A | 11/1993 | Jacobsen | |
| 5,433,339 | A | 7/1995 | Sarver | |
| 5,484,081 | A | 1/1996 | Jahn | |
| 5,505,330 | A * | 4/1996 | Nunes | 220/742 |
| D372,844 | S | 8/1996 | Nunes | |
| 5,647,624 | A | 7/1997 | Beshara, Jr. | |
| D384,557 | S | 10/1997 | Goza | |
| 5,732,851 | A | 3/1998 | Griffin et al. | |
| 5,788,298 | A | 8/1998 | Cheng | |
| 5,868,310 | A | 2/1999 | Leszczynski | |
| 5,951,076 | A | 9/1999 | Marco | |
| D440,496 | S | 4/2001 | Adam et al. | |
| 6,260,732 | B1 * | 7/2001 | Khodush | 220/737 |
| D459,942 | S | 7/2002 | Miller | |
| 6,557,751 | B2 | 5/2003 | Puerini | |
| 6,588,064 | B2 * | 7/2003 | Baum | 16/422 |
| 6,602,231 | B1 | 8/2003 | Mariea | |
| 6,708,838 | B2 * | 3/2004 | Bergman et al. | 220/757 |
| D511,937 | S | 11/2005 | Liu | |
| 6,962,265 | B1 * | 11/2005 | Zhang | 220/759 |
| 7,003,849 | B2 * | 2/2006 | Cohen et al. | 16/232 |
| 7,080,753 | B1 | 7/2006 | Miller | |
| 2004/0129852 | A1 | 7/2004 | Giampavolo | |
| 2005/0161462 | A1 * | 7/2005 | Bergman | 220/757 |
| 2007/0295738 | A1 | 12/2007 | Hussain | |
| 2009/0014454 | A1 * | 1/2009 | Nelson | 220/758 |

FOREIGN PATENT DOCUMENTS

| | | | |
|---|---|---|---|
| GB | 2407252 | B2 | 5/2006 |
| JP | 08119252 | A | 5/1996 |
| JP | 08192853 | A | 7/1996 |
| JP | 2000006982 | A | 1/2000 |
| JP | 2000102472 | A | 4/2000 |
| JP | 2001190388 | A | 7/2001 |
| JP | 2002034760 | A | 2/2002 |
| JP | 2002272582 | A | 9/2002 |
| JP | 2002337882 | A | 11/2002 |
| JP | 2003231527 | A | 8/2003 |
| JP | 2003275035 | A | 9/2003 |
| JP | 2005096808 | A | 5/2005 |
| KR | 2096157 | A | 12/2002 |
| WO | 2006031569 | A3 | 3/2006 |

* cited by examiner

DETACHABLE FOLDABLE HANDLE FOR DRINKING VESSELS

FIELD OF THE INVENTION

The invention generally relates to handles for drinking vessels, and more specifically to detachable, reusable handles for drinking vessels.

BACKGROUND OF THE INVENTION

During consumption of a beverage from a drinking vessel, such as a cup, glass, mug, open soda can, open beer can, stein, and such like, holding the vessel can sometimes be uncomfortable or otherwise problematic. If the beverage is warm or cold, the vessel can become uncomfortably warm or cold to the touch. In addition, a cold beverage can cause a drinking vessel to condense moisture on its outer surface, thereby making the vessel slippery and causing the hand of a consumer to become uncomfortably wet.

One solution to this problem is to provide a handle to facilitate grasping of a drinking vessel. For example, a reusable tea cup, coffee mug, or beer stein typically includes a handle that is permanently attached thereto. The handle provides for easy grasping of the drinking vessel without exposing a user's hand to uncomfortable temperatures or condensed moisture.

Handles are also sometimes included with disposable paper beverage cups. Typically, the handle is split into two flat halves that are initially aligned against the outer surface of the cup, so as to allow for easy stacking and storage of a plurality of cups. At time of use, the two halves are bent away from the cup and held together by the hand of a user. While providing the basic benefits of a handle, this approach can be inconvenient and uncomfortable, since the halves of the handle can be difficult to separate from the surface of the cup, and are typically uncomfortable to grasp. Also, the need to provide a handle with each disposable cup results in significant added cost, due to the extra handle pieces and gluing thereof that must be included in the manufacture of each disposable vessel. Other types of disposable drinking vessel, such as open beer and open soda cans, typically do not include a handle of any sort.

A convenient and comfortable approach for holding a drinking vessel, such as a disposable drinking vessel, that does not include a permanent handle, is to provide a reusable, detachable handle that can be attached to the drinking vessel during use, and then detached for reuse once the beverage has been consumed. One type of reusable, detachable handle includes one or more rings that can surround the drinking vessel. However, this approach can typically be used only with drinking vessels that fall within a narrow range of diameters, and are either tapered in shape or have a pronounced lip near the upper rim. Otherwise, handles of this type can slip in location, causing the drinking vessel to become unstable or even to slip away from the handle. Also, handles of this type are generally bulky in size, and therefore inconvenient to carry and store.

Another type of reusable, detachable handle includes a clamping mechanism that attaches firmly to the upper rim of a drinking vessel, and a bumper that rests against the lower side of the vessel. While this approach is compact and adaptable to a wide range of drinking vessel sizes and shapes, attachment of this style of handle to a drinking vessel can be uncertain and unreliable, especially if the vessel is made from a flexible material such as paper or thin aluminum, since the handle only grips the vessel at the rim. Also, the cost of such a handle can be high, due to the complexity of the clamping mechanism.

Yet another type of reusable, detachable handle attaches to the top and bottom of a drinking vessel. This type of handle is typically somewhat flexible, and includes shaping with notches and/or tabs at each end so as to couple with the upper and lower rims of the vessel. The handle is flexed so as to position the two ends over the upper and lower rims of the drinking vessel, and then released so as to cause the ends of the handle to press against the upper and lower rims and thereby firmly grasp the vessel. While this approach is adaptable to a wide variety of vessel shapes and diameters, each handle can be used with only a narrow range of vessel heights. Also, the handle must be at least as long as the vessel, and so tends to be somewhat bulky in size, and therefore inconvenient to carry and store

SUMMARY OF THE INVENTION

A reusable, detachable handle is claimed that attaches to both the upper and lower rims of a drinking vessel, so as to provide stable and reliable attachment thereto. The claimed handle can be folded when not in use, so as to provide for convenient and compact carrying and storage. Preferred embodiments of the claimed handle are adjustable in length, and/or provide a plurality of base-gripping features, so as to be adaptable to vessels of different heights. Some preferred embodiments include a fixed or slideable gripping spike that enhances gripping security by pressing against the upper rim in opposition to the upper end of the reusable handle. Further preferred embodiments include a bottle opener, and some preferred embodiments are attachable to a key ring or include a key ring.

One general aspect of the present invention is a detachable handle for use with a drinking vessel. The detachable handle includes an upper end that is shaped so as to press against and grip an upper rim of the drinking vessel, a lower end that is shaped so as to press against and grip a lower rim of the drinking vessel, a middle section that connects the upper end to the lower end, the middle section being foldable so as to fold the detachable handle into a storage configuration, and a latching mechanism that is able to fix the middle section in an unfolded configuration.

In preferred embodiments, the detachable handle can be used with a disposable drinking vessel. In some preferred embodiments the unfolded configuration of the middle section is a curved configuration.

In various preferred embodiments, when the middle section is fixed in the unfolded configuration, it can be flexed so as to place the upper and lower ends respectively above and below the upper and lower rims of the drinking vessel, and then released, so as to grip the drinking vessel by pressing the upper and lower ends against the upper and lower rims respectively. And in certain preferred embodiments the middle section includes a hinge that allows the middle section to be folded.

In some preferred embodiments, the latching mechanism includes a rigid sleeve that is slidable over a foldable portion of the middle section so as to prevent folding of the middle section, the rigid sleeve being slidable away from the foldable portion so as to enable folding of the middle section. In other preferred embodiments the latching mechanism includes a flap that is able to bridge a foldable portion of the middle section, a distal end of the flap being attachable to the middle portion by engagement of a protrusion with the flap, thereby fixing the detachable handle in its unfolded configuration.

In preferred embodiments, the middle section is adjustable in length. In some preferred embodiments the middle section includes a telescoping portion that allows adjustment of the length of the middle section. And in some of these embodiments the telescoping portion includes a member with a protrusion and a member with at least one receptacle, each receptacle being one of an indentation and a hole, the members being configured so as to fix the length of the telescoping portion when the protrusion is inserted into a receptacle.

In various preferred embodiments the middle section includes at least one base gripping structure that is able to press against and grip a lower end of a drinking vessel that is too short to be gripped by the lower end of the detachable handle. Some preferred embodiments further include a key ring attachment that enables attachment of the detachable handle to a key ring. And other preferred embodiments further include a key ring attached thereto.

Preferred embodiments further include a gripping spike located near the upper end of the detachable handle, the gripping spike being able to participate in gripping of the upper rim of the drinking vessel by pressing against the upper rim of the drinking vessel in opposition to the upper end of the detachable handle. And in some of these embodiments the gripping spike is movable in location along the detachable handle, so as to be movable into a pressing relationship with the upper rim of the drinking vessel, in opposition to the upper end of the detachable handle.

Certain preferred embodiments further include a bottle opening protrusion that can be used to remove a bottle cap from a bottle.

Another general aspect of the present invention is a detachable handle for use with a drinking vessel. The detachable handle includes an upper end that is shaped so as to press against and grip an upper rim of the drinking vessel, a lower end that is shaped so as to press against and grip a lower rim of the drinking vessel, and a middle section that connects the upper end to the lower end, the middle section being foldable so as to fold the detachable handle into a storage configuration.

The detachable handle further includes a latching mechanism that is able to fix the middle section in a curved, unfolded configuration that can be flexed so as to place the upper and lower ends respectively above and below the upper and lower rims of the drinking vessel, and then released, so as to grip the drinking vessel by pressing the upper and lower ends against the upper and lower rims respectively.

The detachable handle further includes a gripping spike located near the upper end of the detachable handle, the gripping spike being able to participate in gripping of the upper rim of the drinking vessel by pressing against the upper rim of the drinking vessel in opposition to the upper end of the detachable handle, the gripping spike being movable in location along the detachable handle, so as to be movable into a pressing relationship with the upper rim of the drinking vessel, in opposition to the upper end of the detachable handle, and at least one base gripping structure that is able to press against and grip the lower rim of the drinking vessel if the drinking vessel is too short to be gripped by the lower end of the detachable handle.

In preferred embodiments the latching mechanism includes a flap that is able to bridge a foldable portion of the middle section, a distal end of the flap being attachable to the middle portion by engagement of a protrusion with the flap, thereby fixing the detachable handle in its unfolded configuration.

In some preferred embodiments the middle section includes a hinge that allows the middle section to be folded. And in other preferred embodiments the middle section is adjustable in length.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1:
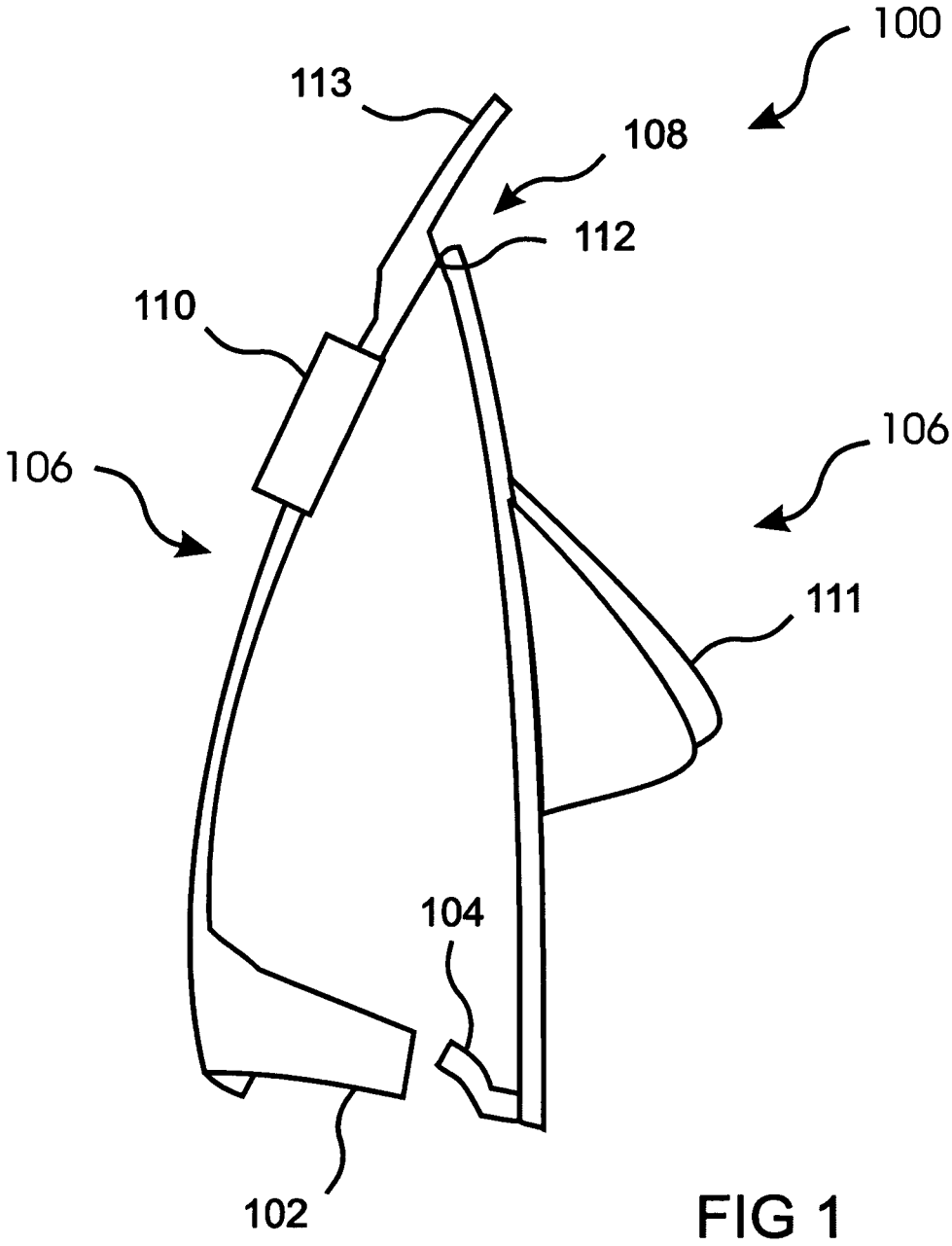
FIG. 1 is a perspective drawing of a preferred embodiment in a folded configuration.

With reference to FIG. 1, the present invention is a detachable handle 100 that includes an upper end 102, a lower end 104, and a middle section 106 that connects the upper end 102 to the lower end 104. The middle section 106 includes a foldable portion 108 that can be bent so as to allow the detachable handle 100 to be folded into a storage configuration and unfolded into a fixed, curved, unfolded configuration. This foldable portion 108 thereby allows the detachable handle 100 to be folded into a compact shape for portable storage when it is not in use. The detachable handle 100 can be made of a metal, such as aluminum, or of a semi-rigid, durable plastic. The embodiment of FIG. 1 further includes a sleeve 110 that can be slid over the foldable portion 108 so as to lock it into an unfolded configuration. Wing-like projections 111 are included so as to provide a more secure and comfortable grasp, and to balance and stabilize smaller cups when set to rest on a flat surface while still connected to the handle. In this embodiment, the foldable portion 108 included in the middle section 106 of the detachable handle 100 is a "hinge" formed by a thin strip of bendable plastic 112. In similar embodiments, the hinge 112 is a traditional interlocking hinge. The hinge 112 includes a flap 113 that overlaps the hinge 112 and keeps the middle section 106 from being bent beyond its unfolded configuration.

Figure 2A:
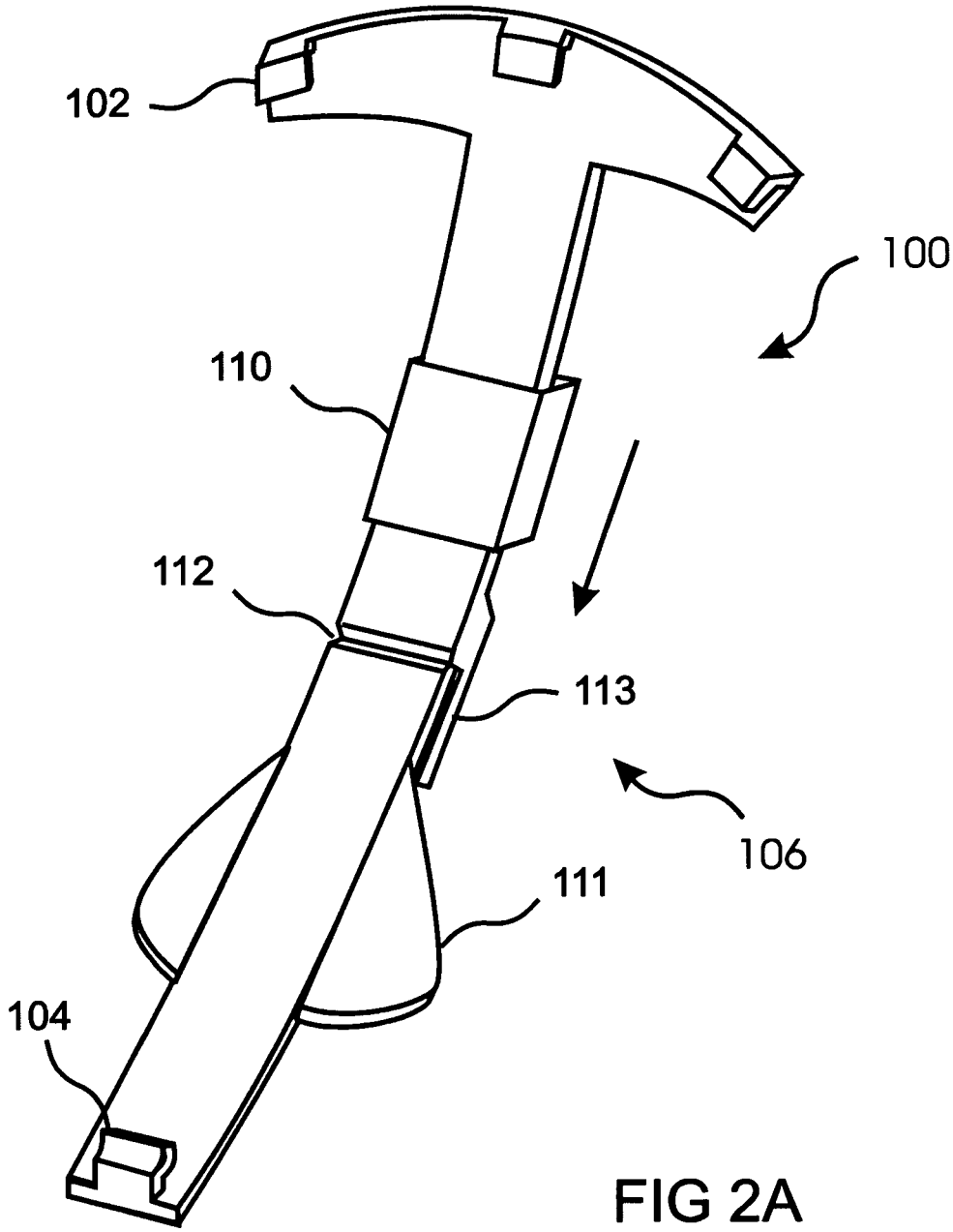
FIG. 2A is a perspective drawing of the preferred embodiment of FIG. 1 showing the embodiment unfolded and ready to be locked in its unfolded configuration.
Figure 2B:
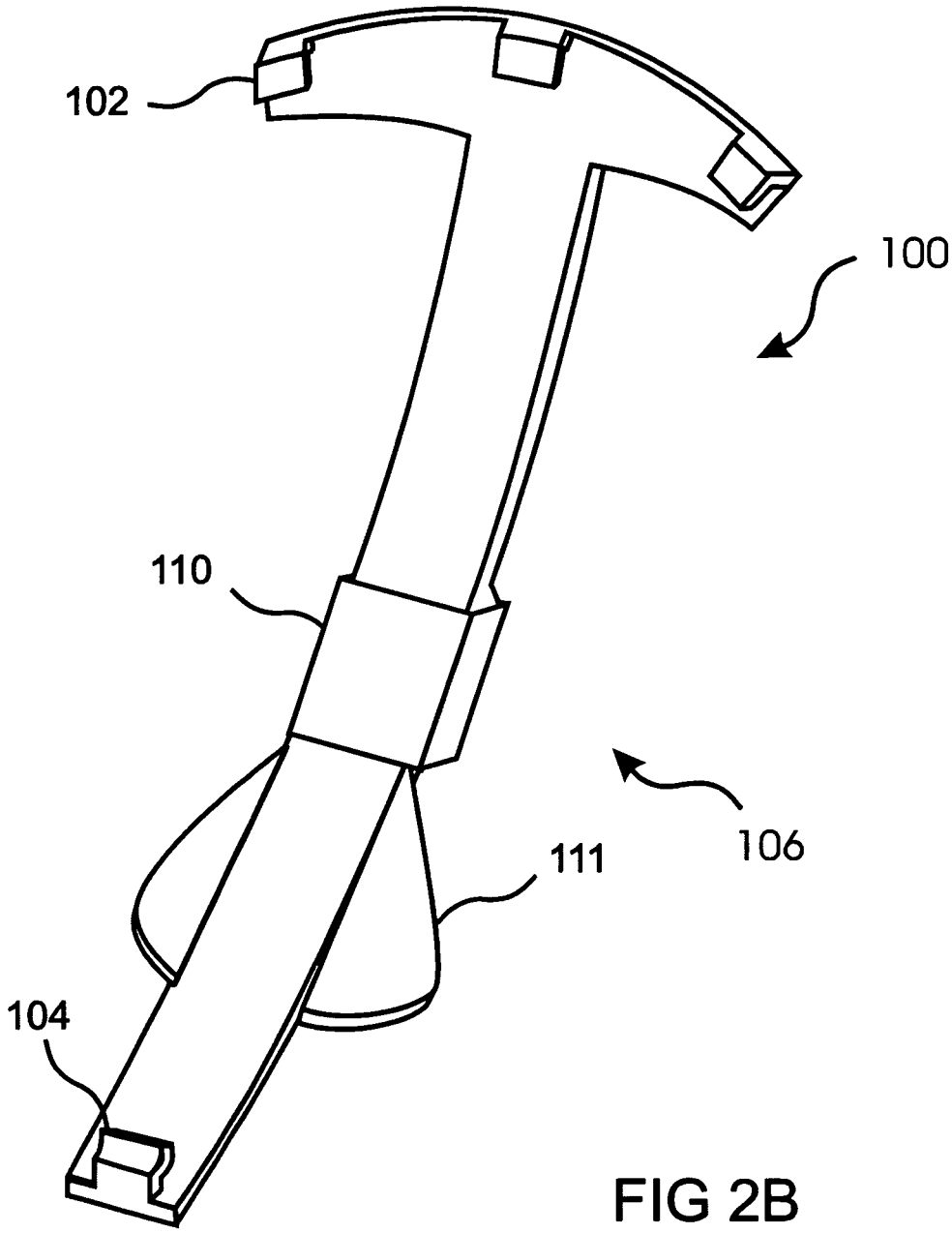
FIG. 2B is a perspective drawing of the preferred embodiment of FIG. 2A showing the embodiment locked in its unfolded configuration by a rigid sleeve that has been slid over a foldable portion.

FIG. 2A is a perspective drawing of the preferred embodiment of FIG. 1, illustrating the detachable handle 100 unfolded and ready to be fixed in its unfolded configuration by sliding a rigid sleeve 110 over the hinge 112 so as to prevent folding of the middle section 106. The rigid sleeve 110 can then be slid away from the hinge 112 so as to enable folding of the middle section 106. FIG. 2B is a perspective drawing of the preferred embodiment of FIG. 2A showing the detachable handle 100 fixed in its unfolded configuration due to sliding of the rigid sleeve 110 over the hinge 112.

Figure 3:
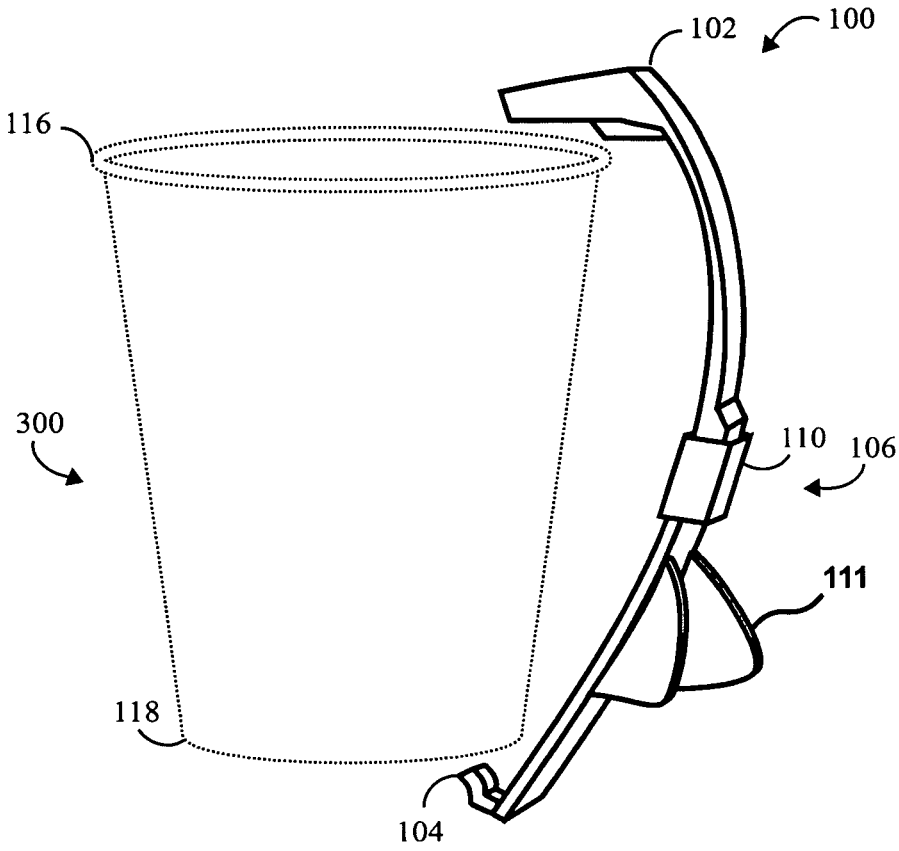
FIG. 3 is a perspective drawing of the embodiment of FIG. 2B, showing the embodiment prepared for attachment to a drinking vessel, with a curved middle section of the embodiment partially straightened so as to position an upper end and a lower end of the embodiment respectively above an upper rim and below a lower rim of the disposable drinking vessel.

FIG. 3 is a perspective drawing of the preferred embodiment of FIG. 2B showing the detachable handle 100 prepared for attachment to a drinking vessel 300. The middle section 106 is elastic, which allows the detachable handle 100, while fixed in the curved, unfolded configuration, to be at least partially straightened so as to position the upper end 102 and the lower end 104 against the upper rim 116 and the lower rim 118 of the hot drinking vessel 114, as shown in the figure.

Figure 4:
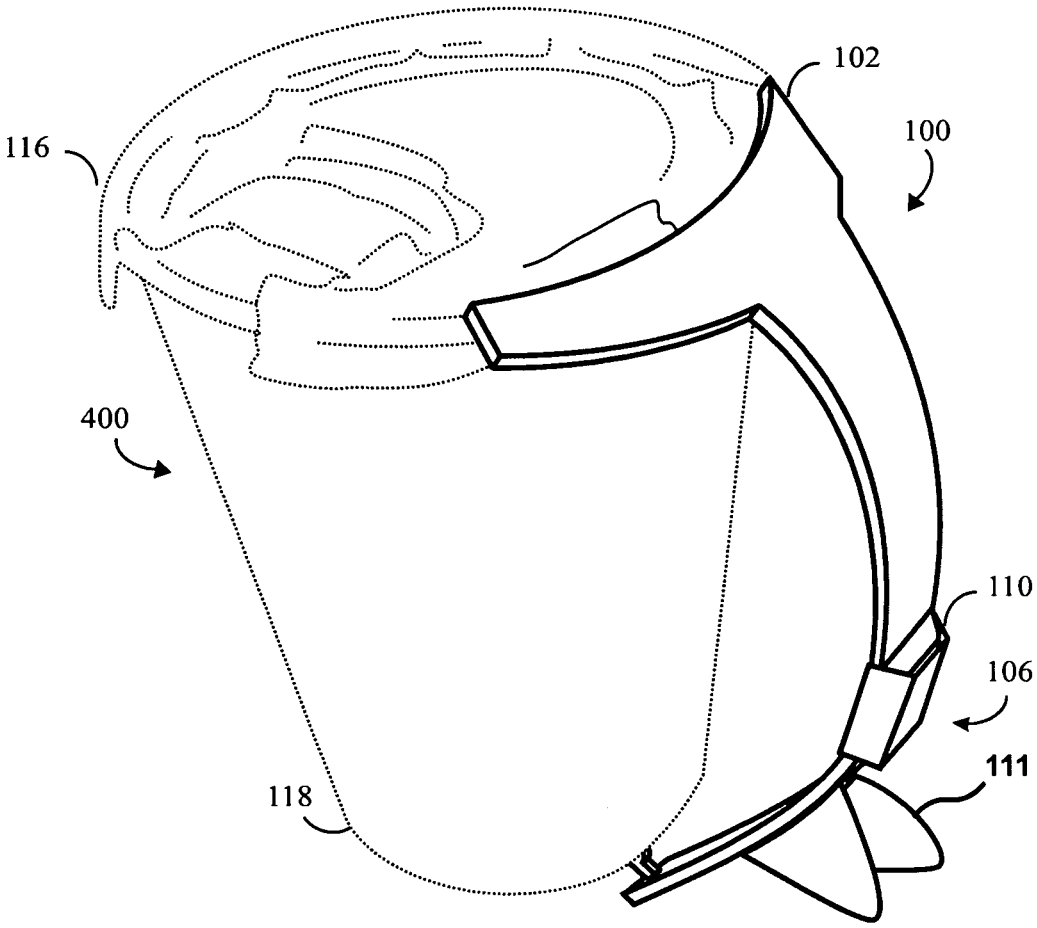
FIG. 4 is a perspective drawing of the embodiment of FIG. 3, showing the embodiment attached to a disposable hot drinking vessel.

FIG. 4 is a perspective drawing of the preferred embodiment of FIG. 3 showing the curved middle section 106 no longer partially straightened, thereby causing the upper end 102 and the lower end 104 of the detachable handle 100 to press against and grip the upper rim 116 and the lower rim 118 respectively of a disposable hot drinking vessel 400.

Figure 5:
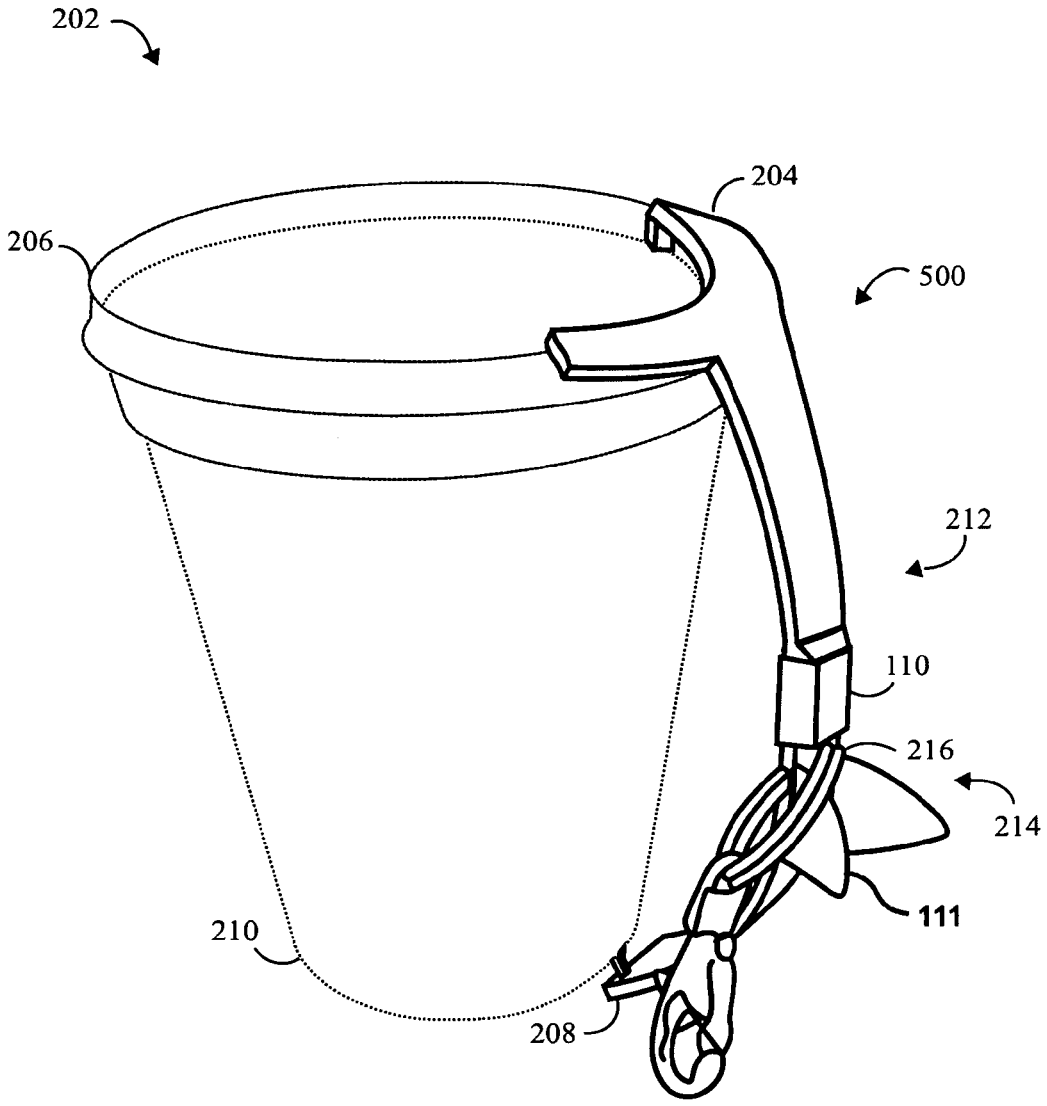
FIG. 5 is a perspective drawing of an alternate embodiment similar to the embodiment of FIG. 4, but including a key ring.

FIG. 5 is a perspective drawing of an embodiment 500 similar to the embodiment of FIG. 4, but further including a key ring attachment 214 that enables attachment of the detachable handle 200 to a key ring 216, so as to provide for ready access whenever needed. In similar embodiments, the detachable handle 200 includes a key ring.

Figure 6:
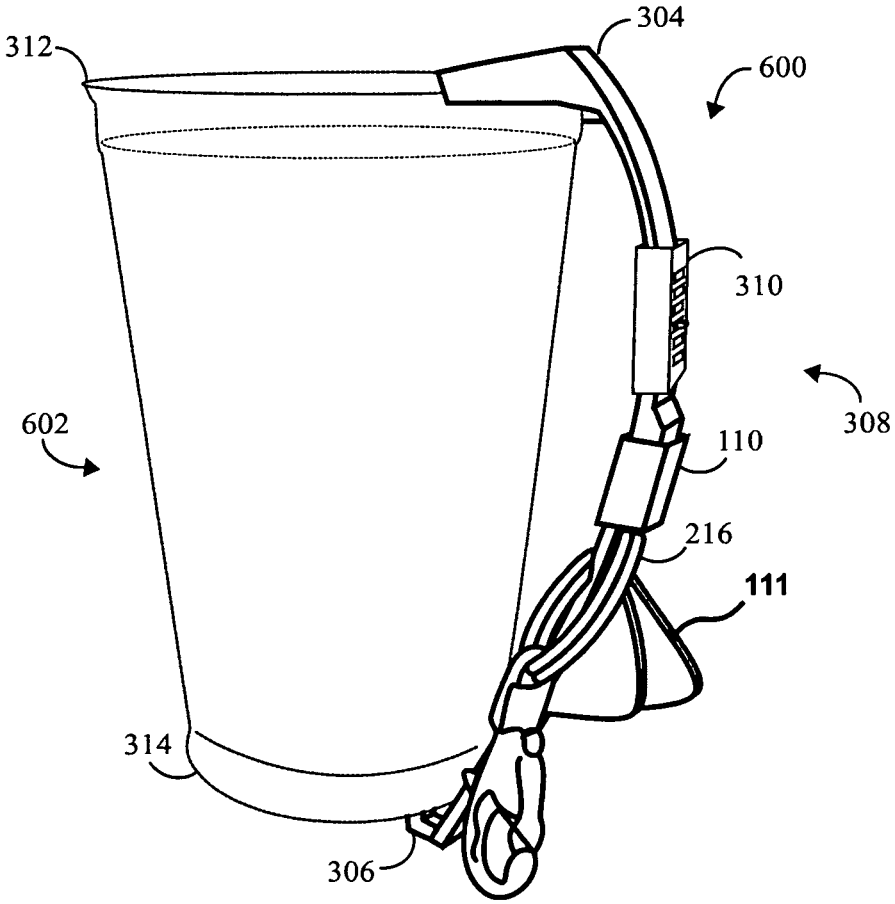
FIG. 6 is a perspective drawing of an embodiment similar to the embodiment of FIG. 5, but including a telescopic portion that allows the length of the middle section to be adjusted, the embodiment being attached to a disposable cold drinking vessel.
Figure 7:
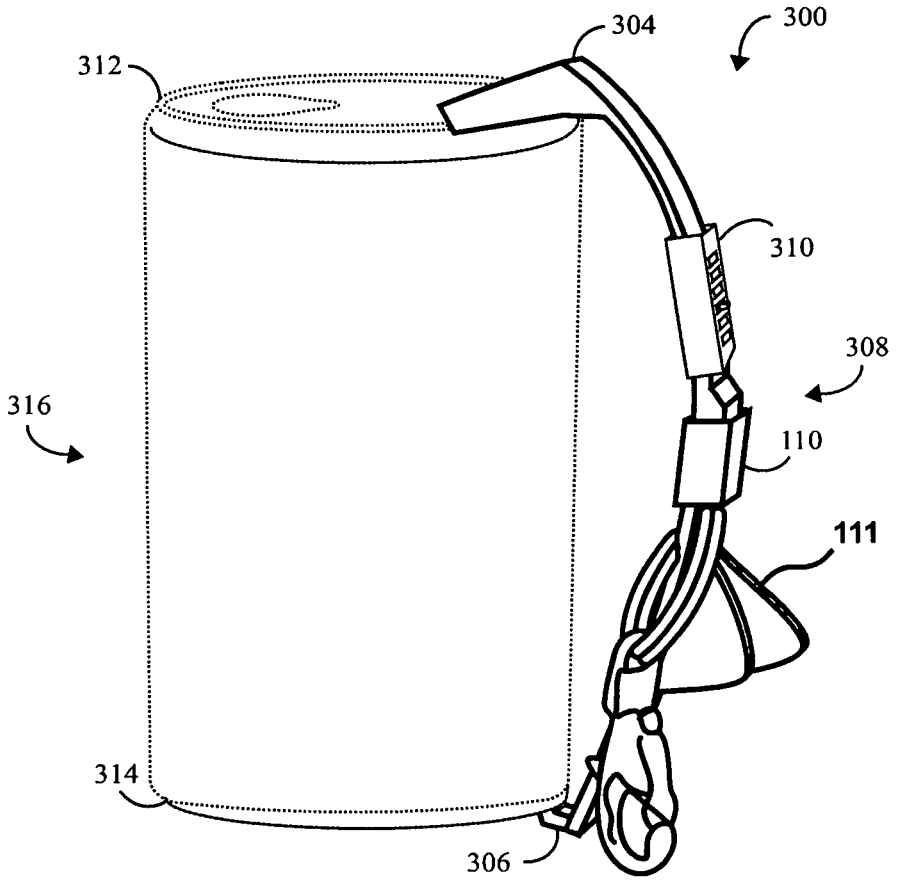
FIG. 7 is a perspective drawing of the embodiment of FIG. 6 attached to a aluminum beverage can.

FIG. 6 is a perspective drawing of a preferred embodiment 600 similar to the embodiment of FIG. 5 illustrated as being attached to a disposable cold drinking vessel 602. As in the embodiment of FIG. 5, the detachable handle 600 of FIG. 6 includes an upper end 304, a lower end 306, a middle section 308 connecting the upper end 304 to the lower end 306, and a key ring attachment 216. However, the embodiment of FIG. 6 also includes a telescopic portion 310 that allows the length of the middle section 308 to be adjusted. FIG. 7 is a perspective drawing of the embodiment 600 of FIG. 6 illustrated as being attached to an aluminum beverage can 316.

Figure 8C:
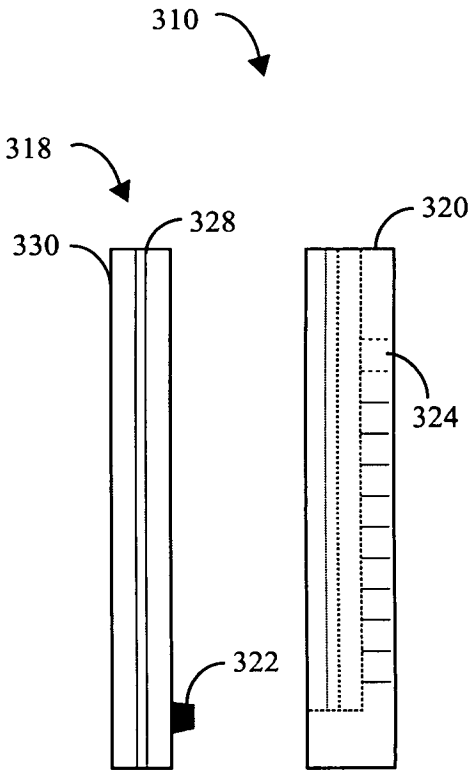
FIG. 8C is a side drawing of the portion of FIG. 8A shown in a dissembled configuration.
Figure 8B:
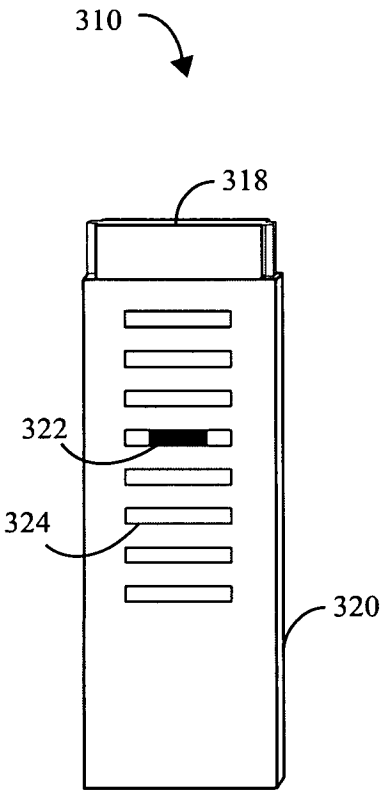
FIG. 8B is a back drawing of the portion of FIG. 8A.
Figure 8A:
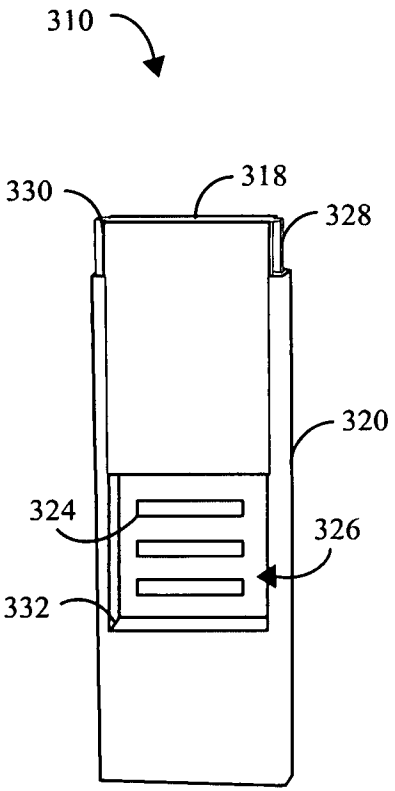
FIG. 8A is a front drawing of a portion of the middle section of the embodiment of FIG. 6 showing the telescopic portion.

FIG. 8A, FIG. 8B and FIG. 8C are a front drawing, a back drawing and a side drawing respectively of the middle section 308 of the embodiment 600 of FIG. 6, providing close-up views of the telescopic portion 310 that allows the length of the middle section 308 to be adjusted. The telescopic portion 310 utilizes a sliding and locking mechanism, including a first member 318 that can slide telescopically within a channel 326 formed in a second member 320, the first member 318 having a protrusion 322 that is able to engage with any of a series of holes 324 provided in the second member 320, thereby fixing the first member 318 in place within the channel 326. Tabs 328 provided on the sides of the first member 318 engage with corresponding slots in the sides of the channel 326 formed within the second member 320, thereby retaining the first member 318 within the channel 326. In the embodiment of FIG. 8, the second member 320 can be flexed so as to pop the protrusion 322 out of a hole 324, thereby allowing adjustment of the length of the middle section 308 of the detachable handle 300 until the protrusion 322 engages with another hole 324.

Figures 9A, 9B, 9C:
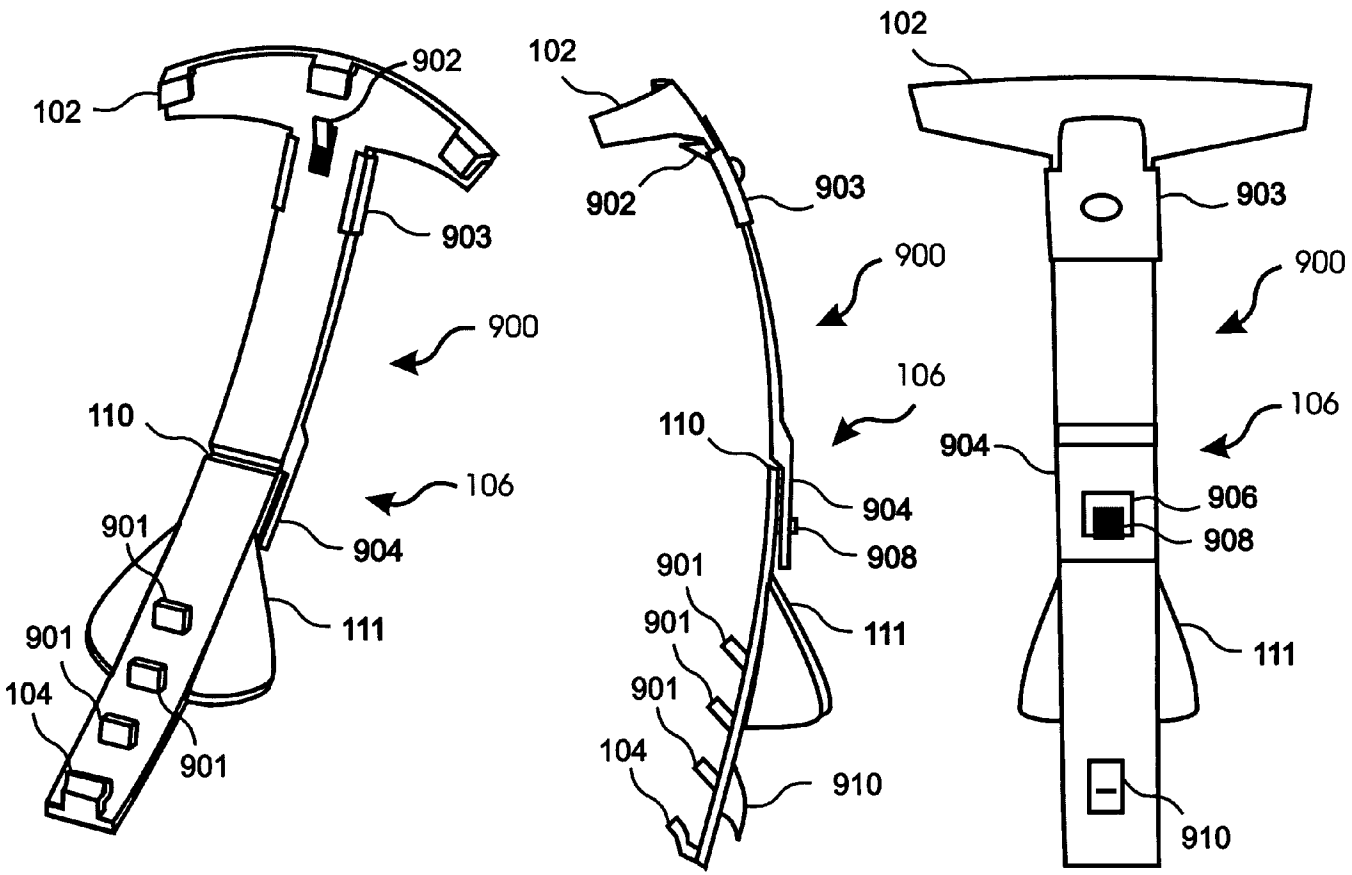
FIG. 9A is a front perspective view of an embodiment of the present invention that includes a gripping spike and a plurality of base-gripping structures arranged so as to accommodate vessels of differing heights.
FIG. 9B is a side view of the embodiment of FIG. 9A, showing a bottle opener included in the embodiment, and a latching mechanism that can lock the embodiment in its unfolded configuration without a sliding sleeve.
FIG. 9C is a rear view of the embodiment of FIG. 9A, showing locations of the bottle opener and locking mechanism.

FIG. 9A, FIG. 9B, and FIG. 9C are a perspective front view, a side view, and a rear view respectively of a preferred embodiment 900 that includes a plurality of base-gripping structures 901, arranged along a lower portion of the handle 900 so as to allow gripping of drinking vessels having a variety of heights. Depending on the height of the drinking vessel, one of the base-gripping structures 901 can engage the base of the vessel, while the other base-gripping structures 901 are either located below the vessel or held away from the side of the vessel by the curvature of the handle 900. This embodiment also includes a gripping spike 902 located near the upper end 102 of the handle 900. The gripping spike 902 is able to work in opposition to the upper end 102 of the handle so as to firmly grip the upper rim of a drinking vessel. In some embodiments, the gripping spike 902 is fixed in position. In the embodiment of FIG. 9A, FIG. 9B, and FIG. 9C, the gripping spike 902 is attached to a slideable mount 903 that allows the gripping spike 902 to be slid upwards so as to firmly engage the gripping spike 902 with the upper rim of a drinking vessel.

Figure 9D:
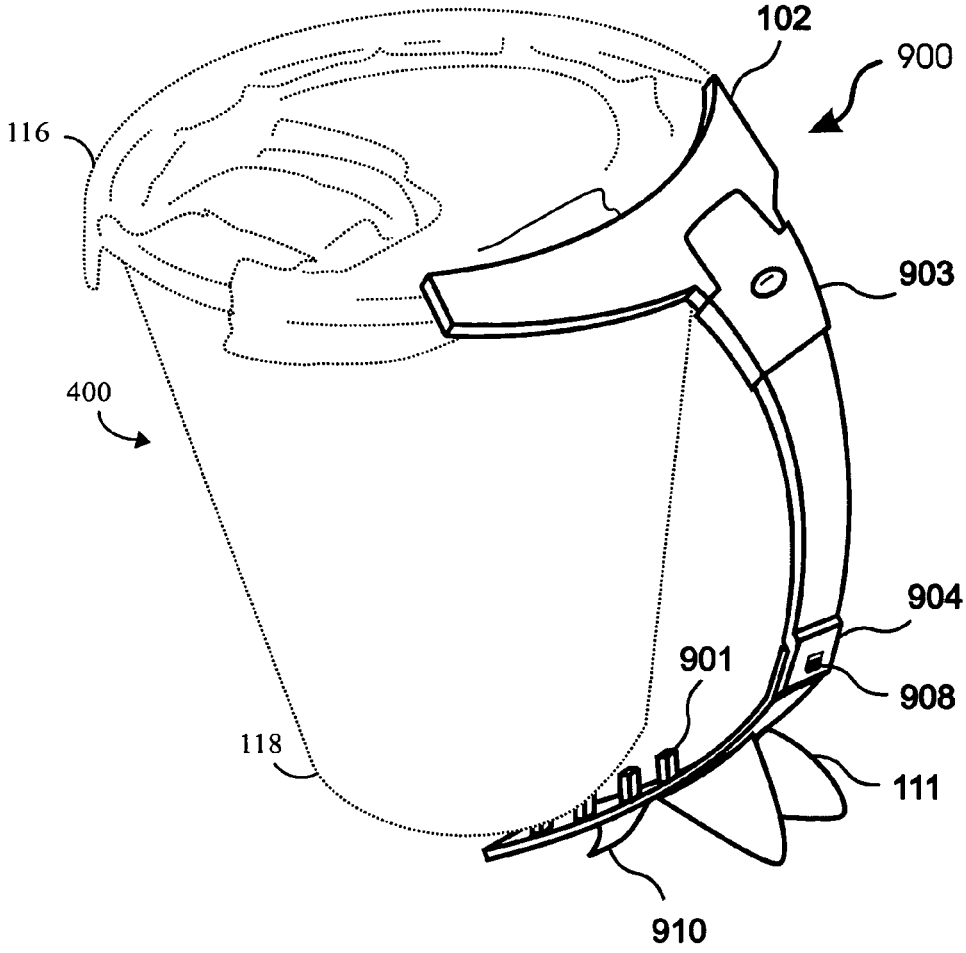
FIG. 9D is a perspective view of the embodiment of FIG. 9A attached to a disposable hot drinking vessel.

The embodiment 900 of FIG. 9A, FIG. 9B, and FIG. 9C further includes a flap 904 that prevents the hinge 110 from being bent beyond its unfolded configuration. The flap 904 is similar to the flap 113 of FIG. 1A, but includes a hole 906 that can be engaged with a peg 908 so as to fix it in its unfolded configuration. A bottle opener 910 is included near the bottom of the rear side of the embodiment 900. FIG. 9D is a perspective view of the embodiment of FIG. 9A, FIG. 9B, and FIG. 9C attached to a hot drinking vessel.

Other modifications and implementations will occur to those skilled in the art without departing from the spirit and the scope of the invention as claimed. Accordingly, the above description is not intended to limit the invention except as indicated in the following claims.

What is claimed is:

1. A universal detachable handle for use with a drinking vessel, the detachable handle comprising:

an upper end that is narrowly shaped so as to press against and grip an upper rim portion of the drinking vessel;

a lower end that is narrowly shaped so as to press against and grip a lower rim of the drinking vessel;

a middle section that connects the upper end to the lower end, the middle section being foldable about a single frictional hinge so as unfold said detachable handle into an open configuration less than 180 degrees and to fold the detachable handle into a storage configuration at an angle of less than 40 degrees;

when the detachable handle is in the open configuration the handle is attached to the drinking vessel by flexing so as to place the upper and the lower ends of the detachable handle above and below the upper and lower rims of the drinking vessel;

a gripping structure located on the upper end of the detachable handle, the gripping structure being attached to a slideable mount and may be adjusted to more firmly hold a drinking vessel by pressing against the upper rim of the drinking vessel in opposition to the upper end of the detachable handle;

when the detachable handle is in the closed configuration the upper and lower ends are in close proximity for storage; and, a plurality of base gripping structures located on the lower end of the detachable handle, the base gripping structures grip the lower end of the drinking vessel by pressing against the lower rim in opposition to the lower end of the detachable handle to enable gripping of drinking vessels of varying heights.

2. The universal detachable handle of claim 1, wherein the narrowly shaped upper end is disposed with claws that grip a small fraction of the total circumference on the upper rim of the drinking vessel.

3. The universal detachable handle of claim 1, wherein the narrowly shaped lower end is upturned so as to grip a small fraction of a total circumference of the lower rim of the drinking vessel.

4. The universal detachable handle of claim 1, wherein, the frictional hinge is formed from interdigitated elements that provide sufficient friction to lock the hinge in the open configuration.

5. The universal detachable handle of claim 1, wherein if the detachable handle is in the closed configuration the detachable handle is sufficiently folded, narrow, and short to be comfortably stored within a front pocket in pants.

6. The universal detachable handle of claim 1 further comprising a bottle opener located on an upper portion of said lower end on the surface of the detachable handle opposite that facing the drinking vessel.

* * * * *